US006321977B1

(12) United States Patent
Lee

(10) Patent No.: US 6,321,977 B1
(45) Date of Patent: Nov. 27, 2001

(54) DRINKING CONTAINER

(76) Inventor: Han-Pin Lee, 6F-2, No. 36, Tung Hsin East Street, Taichung (TW)

( * ) Notice: Subject to any disclaimer, the term of this patent is extended or adjusted under 35 U.S.C. 154(b) by 0 days.

(21) Appl. No.: 09/813,177

(22) Filed: Mar. 20, 2001

(51) Int. Cl.[7] ..... B65D 77/28; A47G 21/18

(52) U.S. Cl. ..... 229/103.1; 220/705; 220/710; 239/24; 239/33

(58) Field of Search ..... 229/103.1; 220/705, 220/709, 710; 215/388; 239/24, 33

(56) References Cited

U.S. PATENT DOCUMENTS

| | | | | |
|---|---|---|---|---|
| 4,573,631 | * | 3/1986 | Reeves | 220/710 |
| 4,858,766 | | 8/1989 | Tsai . | |
| 5,199,633 | * | 4/1993 | Jantzen et al. | 229/103.1 |
| 5,353,983 | * | 10/1994 | Miller | 229/103.1 |
| 5,506,036 | | 4/1996 | Bergerioux . | |
| 5,597,089 | * | 1/1997 | Smith | 220/710 |
| 6,050,444 | * | 4/2000 | Sugg | 220/705 |

* cited by examiner

*Primary Examiner*—Gary E. Elkins
(74) *Attorney, Agent, or Firm*—Senniger, Powers, Leavitt & Roedel

(57) ABSTRACT

An improved drinking container, comprising: a container body having: a side wall, which is recessed inward to form a vertical groove throughout the side wall, in which the vertical groove is defined by at least one inner face; a sealed hole formed on the inner face; and a straw assembly which is mounted in the vertical groove, the straw assembly including: a straw having a vertical section, a bent section and a joint at which the vertical section and bent section are joined together, the bent section having a free end for piercing the sealed hole inward; a block which has a through hole for the bent section of the straw being inserted therethrough, in which the block is secured in the vertical groove with the through hole being aligned with the sealed hole formed on the inner face of the container body; and a removable stop ring which is disposed on the straw to keep the free end of the bent section of the straw from the sealed hole; whereby the free end of the bent section inserted through the through hole of the block stays out of the sealed hole of the container body before drinking, and by removing the stop ring and moving the bent section inward, the free end of the bent section pierces the sealed hole to be ready for drinking.

22 Claims, 8 Drawing Sheets

DRINKING CONTAINER

FIELD OF THE INVENTION

The present invention relates to an improved drinking container. More particularly, the present invention relates to a drinking container having an improved straw assembly connected thereto.

BACKGROUND OF THE INVENTION

Conventionally, a drinking container, such as a Tetra Pak™ container, has a hole on an upper surface of the container. The hole is sealed by a layer of material, for example, aluminum foil. In addition, an external straw is attached to a side wall of the container by an adhesive. By detaching the external straw from the side wall and inserting it into the hole, a user can suck the liquid out of the container.

The above method of drinking has several disadvantages. First, after long-term storage, a certain amount of dust will accumulate on the upper surface of the container. By inserting the straw into the hole, the dust will fall into the container, which in turn will contaminate the liquid therein and may affect the user's health.

Furthermore, since the straw is attached to the side wall of the container by an adhesive, during the transportation of the container or while stacking several containers on the shelf, the straw is easily separated from the container or broken by collision between containers.

In addition, sometimes the straw will fall into the container, which forces the user to cut the container or to pour the liquid into a cup to continue drinking.

Another drinking container relates to a gable-topped container without the provision of a straw. Before drinking the liquid therein, the container has to be opened, causing the liquid to splash out.

Moreover, even though an external straw can be used for the gable-topped container, the straw is easily lost in the container or only a small portion of the straw is left outside the opening of the container.

A further example relates to an easy-to-open metallic can with an easy-opening tab provided on the upper surface of the can. In order to drink the liquid therein, a user has to pull on the tab to reveal an opening, and then put his mouth on the opening. However, the mouth may be hurt accidentally by the edge around the opening. Instead, an external straw has to be inserted into the opening or the liquid has to be poured into a cup, which, however, is inconvenient for the user.

In addition, for a plastic or PET (Polyethylene Terephthalate) drinking container having a cap and a layer of material sealing an opening of the container, usually, the user has to screw off the cap, tear the sealing, and insert an external straw into the opening or pour the liquid directly into a cup. Again, it is inconvenient for the user.

SUMMARY OF THE INVENTION

To overcome the above drawbacks, an objective of the present invention is to provide an improved drinking container, wherein while using the straw assembly, the liquid within the container body is not easily contaminated.

Another objective of the present invention is to provide an improved drinking container, wherein the straw assembly is attached to the outside of the container body and is not easily separated from the container body due to collision.

Still another objective of the present invention is to provide an improved drinking container, wherein the straw cannot fall into the container body.

A further objective of the present invention is to provide an improved drinking container, wherein the straw assembly is applicable to a variety of containers.

To achieve the above objectives, the improved drinking container, in accordance with the first embodiment of the present invention, comprises: a container body having: a side wall, which is recessed inward to form a vertical groove throughout the side wall, in which the vertical groove is defined by at least one inner face; a sealed hole formed on the inner face; and a straw assembly which is mounted in the vertical groove; the straw assembly including: a straw having a vertical section, a bent section and a joint at which the vertical section and bent section are joined together, the bent section having a free end for piercing the sealed hole inward; a block which has a through hole for the bent section of the straw being inserted therethrough, in which the block is secured to the vertical groove with the through hole being aligned with the sealed hole formed on the inner face of the container body; and a removable stop ring which is disposed on the bent section between the block and the joint of the straw to keep the free end of the bent section of the straw from the sealed hole; whereby the free end of the bent section inserted through the through hole of the block stays out of the sealed hole of the container body before drinking, and by removing the stop ring and moving the bent section inward, the free end of the bent section pierces the sealed hole to be ready for drinking.

In the second embodiment, the container further includes a covering that seals the vertical groove formed on the side wall of the container body so as to fully enclose the straw therein, in which the covering adjacent to the top wall and bottom wall are formed with opening weak lines for a user to access the vertical section and bent section of the straw.

The third and fourth embodiments of the present invention relate to a straw assembly for use with a drinking container having a surface, including: a block having a side wall recessed inward to form a vertical groove throughout the side wall and having a through hole formed at the vertical groove, in which the block is attached to the surface of the container; and a straw having a vertical section, a bent section and a joint at which the vertical section and bent section are joined together, the bent section being frictionally inserted through the through hole of the block and having a free end for piercing the surface of the container; whereby the free end of the bent section inserted through the through hole of the block stays out of the container surface before drinking, and by moving the bent section inward, the free end of the bent section pierces the surface to be ready for drinking.

The fifth embodiment of the present invention is directed to a further improved drinking container, comprising: a container body having a flexible surface; and a straw assembly including: a block at least partially enclosed by the surface of the container body with an end thereof appearing outside the container body; a straw partially received within the block from the end thereof, in which the straw has a free end for piercing the surface of the container body; whereby the free end of the straw inserted through the block stays out of the surface of the container body before drinking, and by moving the straw inward, the free end of the straw pierces the surface of the container body and is ready for drinking.

The sixth embodiment of the present invention modifies the container disclosed in the first embodiment by replacing the stop ring with at least one stop plate which is attached to the block, the removable stop plate further defines a hole which contains the vertical section of the straw mounted within the vertical groove; whereby the free end of the bent section inserted through the through hole of the block stays out of the sealed opening of the through hole before drinking, and by pressing down on the stop plate and moving the bent section inward, the free end of the bent section pierces the sealed opening and is ready for drinking.

The structure and objectives of the present invention will be more readily understood by those skilled in the art from the following description of the preferred embodiments taken in conjunction with the accompanying drawings.

DETAILED DESCRIPTION OF THE PREFERRED EMBODIMENTS

Figure 1:
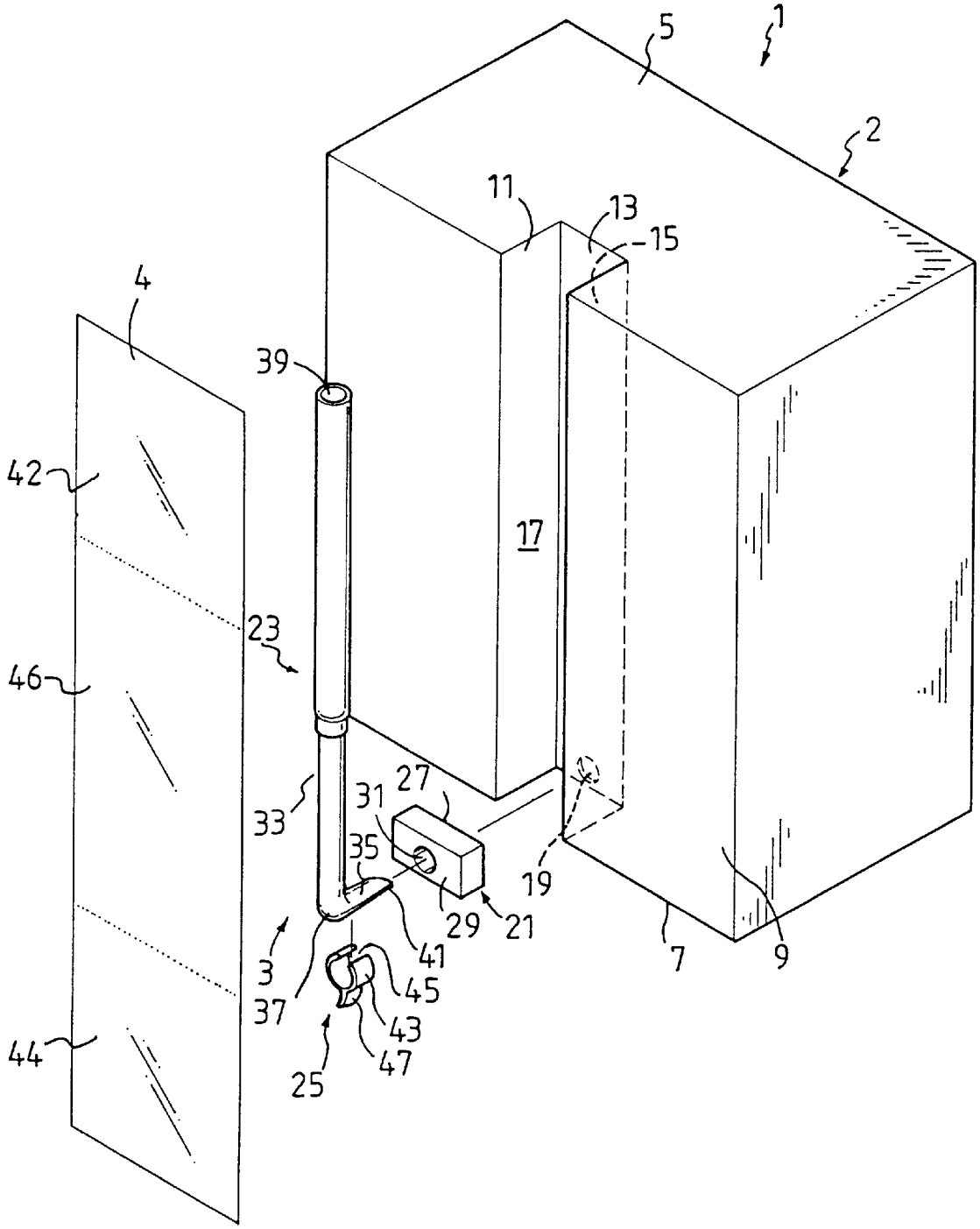
FIG. 1 is an exploded view of an improved drinking container in accordance with the first embodiment of the present invention.
Figure 2:
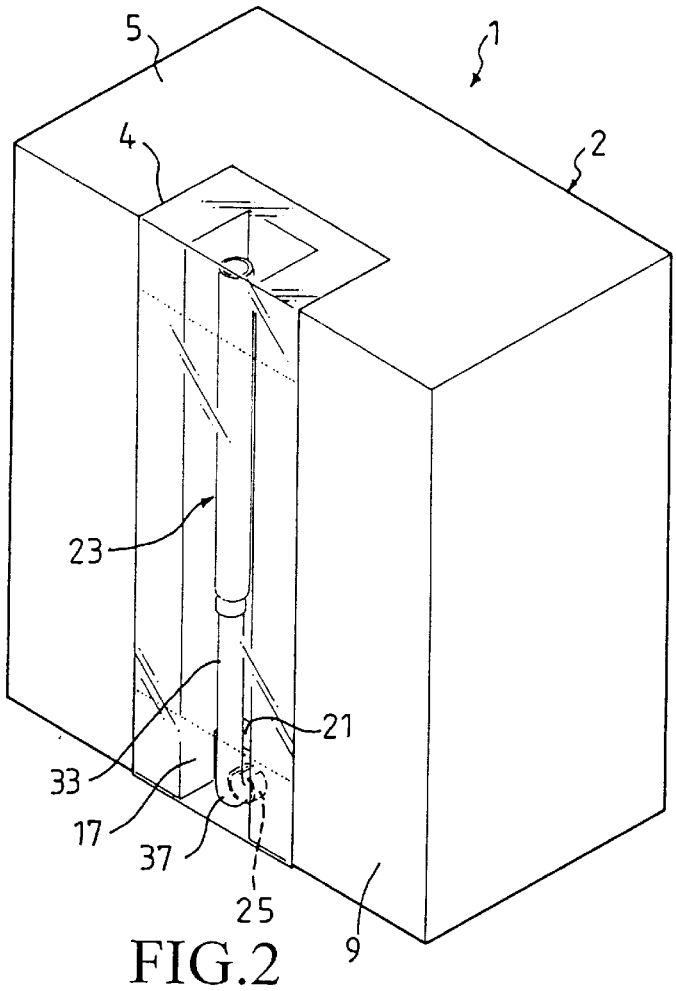
FIG. 2 is a perspective view of the improved drinking container in accordance with the first embodiment of the present invention.
Figure 3:
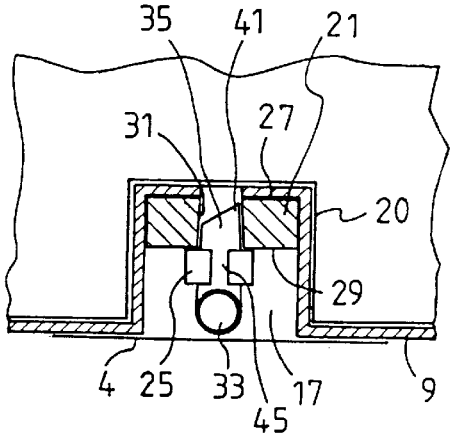
FIG. 3 is a top view of the improved drinking container in accordance with the first embodiment of the present invention.
Figure 4:
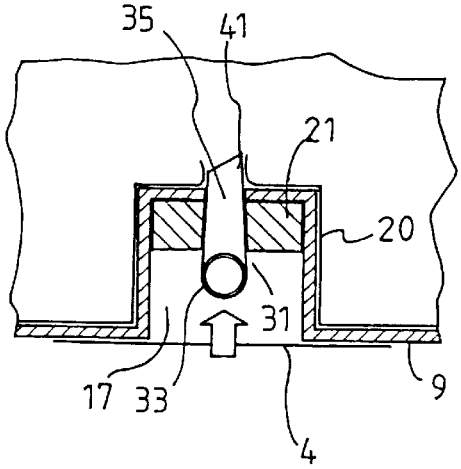
FIG. 4 is another top view of the improved drinking container in accordance with the first embodiment of the present invention, showing the movement of the straw into the container body.
Figure 5:
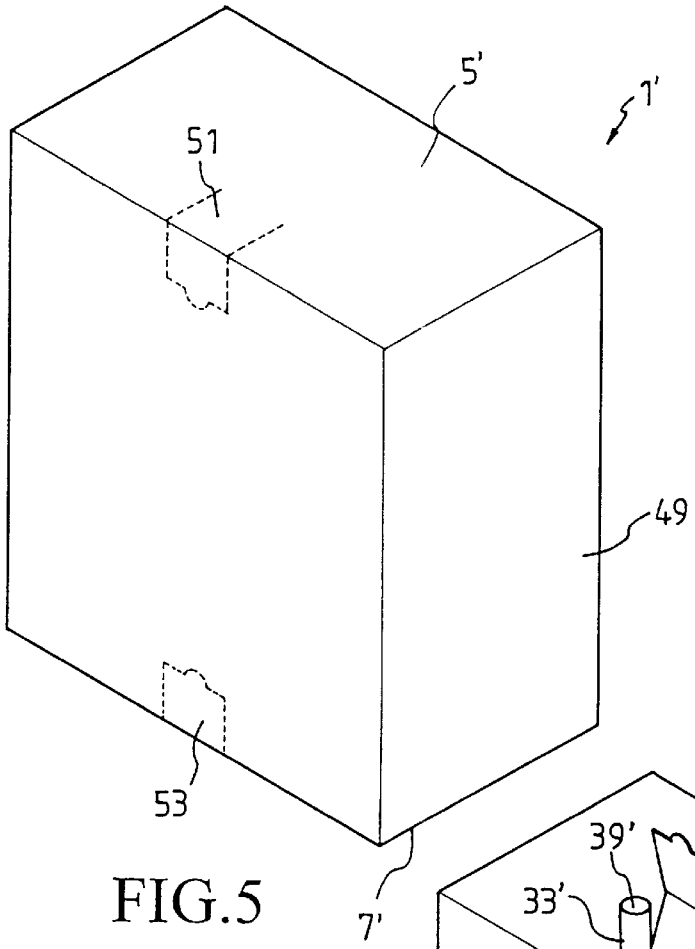
FIG. 5 is a perspective view of an improved drinking container in accordance with the second embodiment of the present invention.
Figure 6:
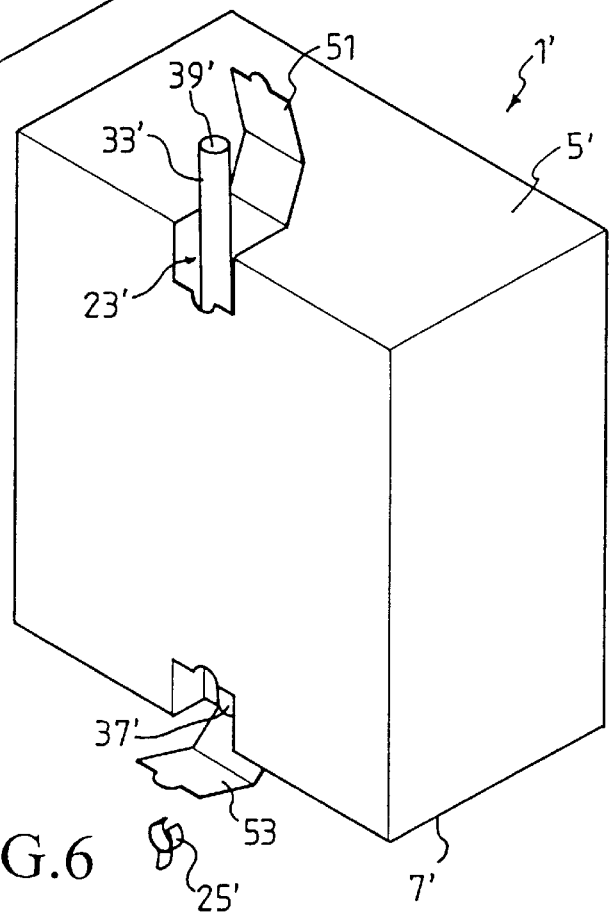
FIG. 6 is another perspective view of the improved drinking container in accordance with the second embodiment of the present invention, showing the state of use of the present invention.

FIGS. 1 and 2 show an improved drinking container in accordance with the present invention. As shown, the container 1 comprises a container body 2, a straw assembly 3 and a covering 4. The container body 2 has a top wall 5, a bottom wall 7, and a side wall 9. The side wall 9 is recessed to form a vertical groove 17 from the top wall 5 through the bottom wall 7. The vertical groove 17 is defined by three inner walls 11, 13, 15. A sealed hole 19 which is preferably sealed by a layer of material 20, for example, aluminum foil, is further formed on the inner wall 13, at a position near the bottom wall 7.

The straw assembly 3, which is preferably made of plastic, comprises a block 21, a straw 23, and a stop ring 25. Preferably, the block 21 is a rectangular parallelepiped and has a rear wall 27, a front wall 29 opposite to the rear wall 27, a conical through hole 31, and two lateral walls. The rear wall 27 of the block 21 is configured to meet the inner wall 13 of the container body 2 for the block 21 to be attached thereto and each of the two lateral walls is respectively attached to the inner walls 11, 15. The aforementioned attachments between the block 21 and the inner walls 11, 13 and 15 are preferably accomplished by adhesion or ultrasonic bonding. The conical through hole 31 extends and tapers from the front wall 29, through the block 21, to the rear wall 27. In addition, the through hole 31 is aligned with the sealed hole 19 on the inner wall 13 of the container body 2.

The straw 23 is received within the groove 17 of the container body 2 and is divided into a vertical section 33 and a bent section 35 which are joined together at a joint 37. The vertical section 33 is telescopic and has an end 39 for a mouth. Preferably, near the mouth end 39, a portion of the vertical section 33 is bellowed (not shown). The bent section 35 has a free end or sharp end 41 for piercing the sealed hole 19. Near the sharp end 41, a portion of the bent section 35 is inserted into the through hole 31 of the block 21 from the front wall 29 of the block 21 with a remaining portion of the bent section 35 left outside the through hole 31. Moreover, the bent section 35 is tapered in accordance with the tapering of the through hole 31 such that after the sharp end 41 pierces the sealed hole 19, it can fit frictionally and tightly with the tapered through hole 31 and the liquid cannot leak from the connection between the bent section 35 and the through hole 31.

The stop ring 25 has a substantially C-shaped cross section and a circumferential wall 43. A notch 45 is formed on the circumferential wall 43 for fitting the stop ring 25 around the remaining portion of the bent section 35 of the straw 23. Further, a tab 47 extends from the circumferential wall 43 of the stop ring 25. The stop ring 25 is positioned between the block 21 and the joint 37 of the straw 23. Preferably, the axial length of the stop ring 25 plus the length of the block 21 is slightly greater than the length of the bent section 35 of the straw 23 to prevent the sharp end 41 of the bent section 35 from being in contact with the sealed hole 19 of the container body 2 before use.

Finally, the layer-shaped covering 4, which is preferably made of plastic, paper or aluminum, is adhered to the container body 2 to cover the groove 17 and seal the straw assembly 3 therein. As shown in FIGS. 1 and 2, a peeling weak line is respectively provided on an upper portion 42 and a lower portion 44 of the covering 4 such that as the upper portion 42 and the lower portion 44 of the covering 4 are torn off the container body 2, the intermediate portion 46 of the covering 4 still covers a portion of the groove 17 and prevents the straw 23 from falling out of the groove 17. Accordingly, the improved drinking container in accordance with the present invention is thus presented.

The operation of the present invention is described in accordance with FIGS. 1–4. First, the upper portion 42 and the lower portion 44 of the covering 4 are torn off and the vertical section 33 of the straw 23 is withdrawn to its full extension. Further, the tab 47 of the stop ring 25 is pulled out to separate the stop ring 25 from the bent section 35 of the straw 23 and the joint 37 is pressed toward the inner wall 13 of the container body 2 until the sealed hole 19 is pierced through by the sharp end 41 of the bent section 35 of the straw 23 and the tapered bent section 35 fits frictionally and tightly with the tapered through hole 31. By adjusting the bellowed portion of the extended vertical section 33 to align the mouth end 39 with the user's mouth, the user can suck liquid out of the container body 2.

FIGS. 5–8 show an improved drinking container 1' in accordance with the second embodiment of the present invention. To simplify the description, the elements in the second embodiment corresponding to those in the first embodiment are denoted by the same reference numerals with an apostrophe ('). In the current embodiment, the structure of the straw assembly 3' and container body 2' are substantially the same as those in the first embodiment except that a covering 49 is used to enclose the container body 2' such that the straw assembly 3' and the vertical groove 17' are not visible from the outside when unused.

As shown, a first portion 51 of the covering 49 adjacent to the top wall 5 is provided with peeling weak lines such that the first portion 51 can be opened to reveal and pull out the end 39' of the vertical section 33' of the straw 23'. Similarly, a second portion 53 of the covering 49 adjacent to the bottom wall 7' is provided with peeling weak lines such that the second portion 53 can be opened for a user to pull out the stop ring 25' and press the joint 37' of the straw 23' toward the inner wall (not shown) of the container body 2'.

Each type of the container 1, 1' can be used for the purpose of short-term liquid storage and long-term liquid storage. For example, in the first embodiment of the container 1 being used for short-term storage, the packaging material for the container body 2 can be made of three layers, namely, a polyethylene layer, a paperboard-based material layer and a liquid-resistant layer. In this case, the sealed hole 19 is formed by removing the polyethylene layer and the paperboard-based material layer and leaving the liquid-resistant layer. In the case of long-term storage, the packaging material for the container body 2 can be made of five layers, namely, a polyethylene layer, a paperboard-based material layer, an adhesive resin layer, a gas-barrier layer, and a liquid-resistant layer. In this case, the sealed hole 19 is formed by removing the polyethylene layer, the paperboard-based material layer and the adhesive resin layer, and leaving the gas-barrier layer and the liquid-resistant layer.

Figure 7:
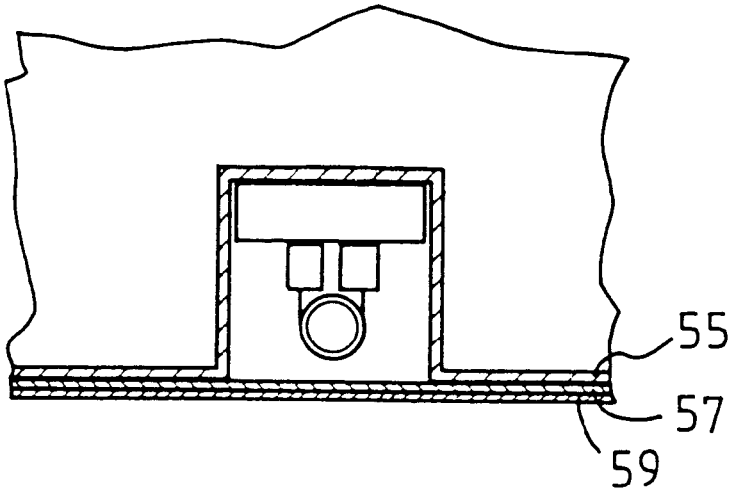
FIG. 7 is a top view of the improved drinking container in accordance with the second embodiment of the present invention, wherein the container is primarily designed for short-term storage.

Further, in the second embodiment of the container 1' being used for short-term storage, the container body 2' may have a liquid-resistant layer 55, and the covering 49 has a paperboard-based material layer 57 and a polyethylene layer 59 for enclosing the straw assembly 3', as shown in FIG. 7. In this case, the sealed hole 19 provided in the first embodiment may not be necessary and the sharp end 41' of the straw 23' can directly pierce through the inner wall, i.e., the liquid-resistant layer 55.

Figure 8:
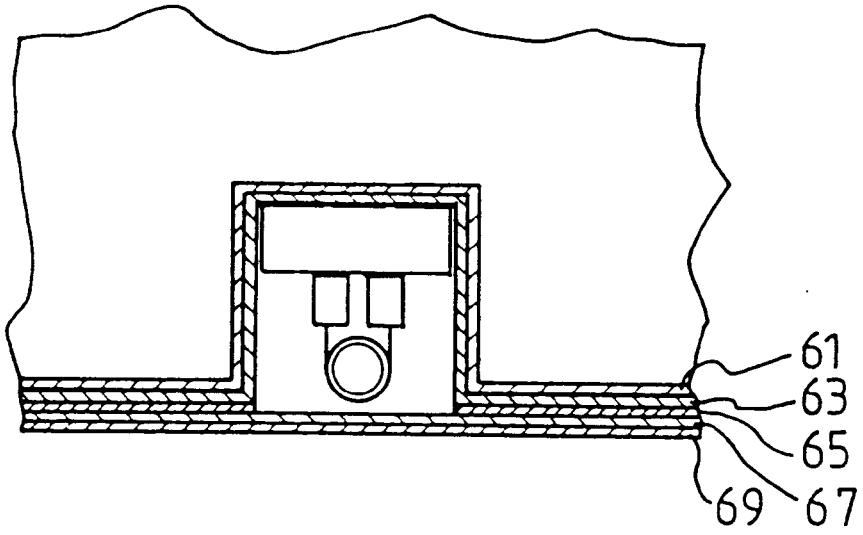
FIG. 8 is a top view of the improved drinking container in accordance with the second embodiment of the present invention, wherein the container is primarily designed for long-term storage.

Furthermore, in the case of long-term storage, the container body 2' has a liquid-resistant layer 61, a gas-barrier layer 63 and an adhesive resin layer 65, and the covering 49 has a paperboard-based material layer 67 and a polyethylene layer 69 for enclosing the straw assembly 3', as shown in FIG. 8. In this case, the sealed hole 19 provided in the first embodiment may not be necessary and the sharp end 41' of the straw 23' can directly pierce through the inner wall, i.e., the liquid-resistant layer 61 and the gas-barrier layer 63.

The above embodiments are merely directed to the preferred embodiments of the present invention. In addition to the above embodiments, there are other possible modifications. For example, the inner wall 13 (13') of the groove 17 (17') can be recessed into an arcuate inner wall and the rear wall 27 (27') of the block 21 (21') can form into a corresponding arcuate wall. Furthermore, the container is not necessarily rectangular but can be of other possible configurations. Also, the container can be a gable-top container and the container body 2 may also be made of plastic materials, paper, metals or other suitable materials. Moreover, the groove 17 (17') does not need to be formed on the side wall 9 (9') of the container body 2 but can also be formed at a corner of the container body 2 (2').

Figure 9:
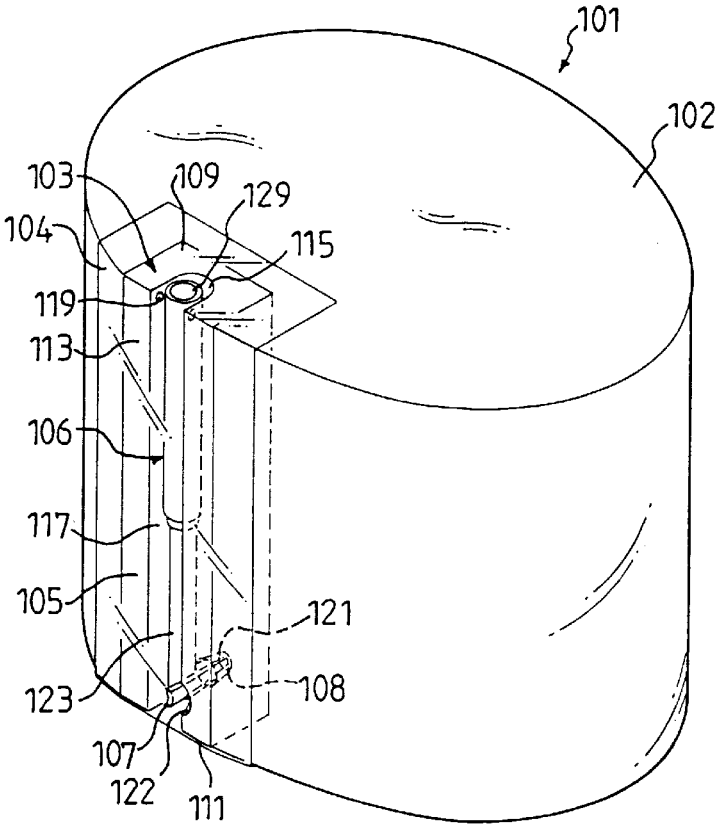
FIG. 9 is a perspective view of the improved drinking container in accordance with the third embodiment of the present invention.
Figure 10:
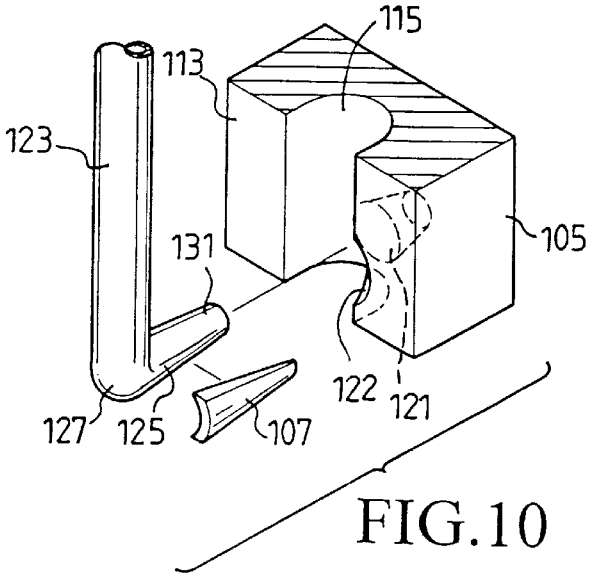
FIG. 10 is a partially exploded view of FIG. 9.

FIGS. 9 and 10 show an improved drinking container 101 in accordance with the third embodiment of the present invention. As shown, the container 101 comprises a flexible body 102, a straw assembly 103 attached to the body 102, and a covering 104.

The flexible body 102 is preferably a plastic body but can also be a PET (Polyethylene Terephthalate) body, a tin can, an aluminum can or a glass bottle, etc. The body 102 is provided with a sealed hole 108 on the surface thereof, which is preferably sealed by a layer of material, for example, aluminium foil. The straw assembly 103, which is preferably made of plastic, includes a block 105, a straw 106 and an insert 107. The block 105 is a rectangular parallelepiped having a top wall 109, a bottom wall 111, a side wall or a front wall 113, a rear wall and two opposite lateral walls. The block 105 is attached to the body 102 by adhering the rear wall and two lateral walls to the body 102. However, the attachment can also be performed by ultrasonic bonding and in some embodiments, the block 105 is formed integrally with the flexible body 102 by injection molding. The front wall 113 is recessed into a vertical groove 115 from the top wall 109 through the bottom wall 111. The vertical groove 115 is thus defined by an inner wall 117 with a substantially C-shaped cross section. In addition, a pair of opposite knobs 119 are provided at an upper end of the inner wall 117, near the top wall 109. Further, a conical through hole 121 extends from a lower portion of the inner wall 117, through the block 105, to the rear wall. The through hole 121 is aligned with the sealed hole 108 of the body 102. In addition, a notch 122 is formed on the intersection of the front wall 113 and the inner wall 117, at a position near the through hole 121.

The straw 106 is received within the groove 115 of the block 105 and is divided into a vertical section 123 and a bent section 125 which are joined together at a joint 127. The vertical section 123 is telescopic and has an end 129 for a mouth. Preferably, near the mouth end 129, a portion of the vertical section 123 is bellowed (not shown). A portion of the bent section 125 is inserted into the through hole 121 and has a free end or sharp end 131 for piercing the sealed hole 108 of the body 102. In addition, the length of the bent section 125 is larger than that of the through hole 121.

As shown in FIG. 10, the insert 107 is in the shape of a wedge body with a side slightly curved. The insert 107 is inserted into the through hole 121 through the notch 122 such that the curved side is pressed against a portion of the bent section 125 to prevent the sharp end 131 of the bent section 125 from piercing the sealed hole 108 of the body 102. Moreover, the bent section 125 is tapered in accordance with the tapering of the through hole 121 such that after the insert 107 is withdrawn from the through hole 121 and the joint 127 is pressed inward for the sharp end 131 to pierce the sealed hole 108 of the body 102, the tapered bent section 125 can fit frictionally and tightly with the tapered through hole 121 and the liquid cannot leak from the connection between the bent section 125 and the through hole 121.

Furthermore, the mouth end 129 of the vertical section 123 is blocked by the opposite knobs 119 such that the straw 106 does not fall from the groove 115.

Finally, the layer-shaped covering 104, which is preferably made of plastic, paper or aluminum, is used to cover the groove 115 to seal the straw assembly 103 therein. Accordingly, the improved drinking container in accordance with the present invention is thus presented.

Figure 11:
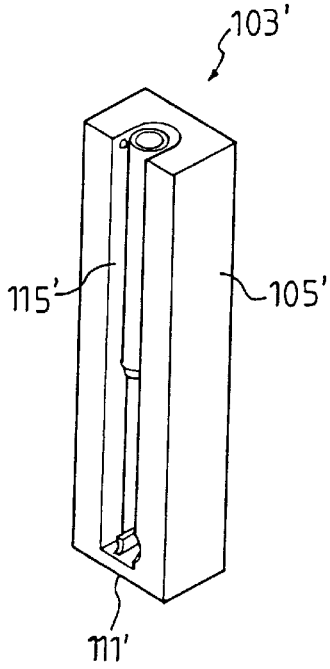
FIG. 11 is a perspective view of the straw assembly for the improved drinking container in accordance with the fourth embodiment of the present invention.

FIG. 11 shows a modified straw assembly 103' in accordance with the fourth embodiment of the present invention. To simplify the description, the elements in the fourth embodiment corresponding to those in the third embodiment are denoted by the same reference numerals with an apostrophe ('). In the current embodiment, the structure of the body 102' and straw assembly 103' are substantially the same as those in the third embodiment except that an end of the vertical groove 115' is blocked by the bottom wall 111'.

The operation of the third and fourth embodiments is described in accordance with FIGS. 9–11. First, the covering 104 (104') is torn off and the vertical section 123 (123') of the straw 106 (106') is withdrawn to its full extension. Further, the insert 107 (107') is pulled out of the through hole 121 (121') and the joint 127 (127') is pressed toward the body 102 (102') until the sealed hole 108 of the body 102 (102') is pierced through by the sharp end 131 (131') of the bent section 125 (125') of the straw 106 (106') and the tapered bent section 125 (125') fits frictionally and tightly with the tapered through hole 121 (121'). By adjusting the bellowed portion of the extended vertical section 123 (123') to align the mouth end 129 (129') with the user's mouth, the user can suck the liquid out of the flexible body 102 (102').

The provision of the insert 107 (107') replaces the requirement of the stop ring. Furthermore, if the surface of the container body 102 can be directly pierced by the sharp end 131 (131') of the straw 106 (106'), the provision of the sealed hole 108 (108') is not necessary and the straw assembly 103 (103') can be attached to the contain body 102 (102') anywhere.

Figure 12:
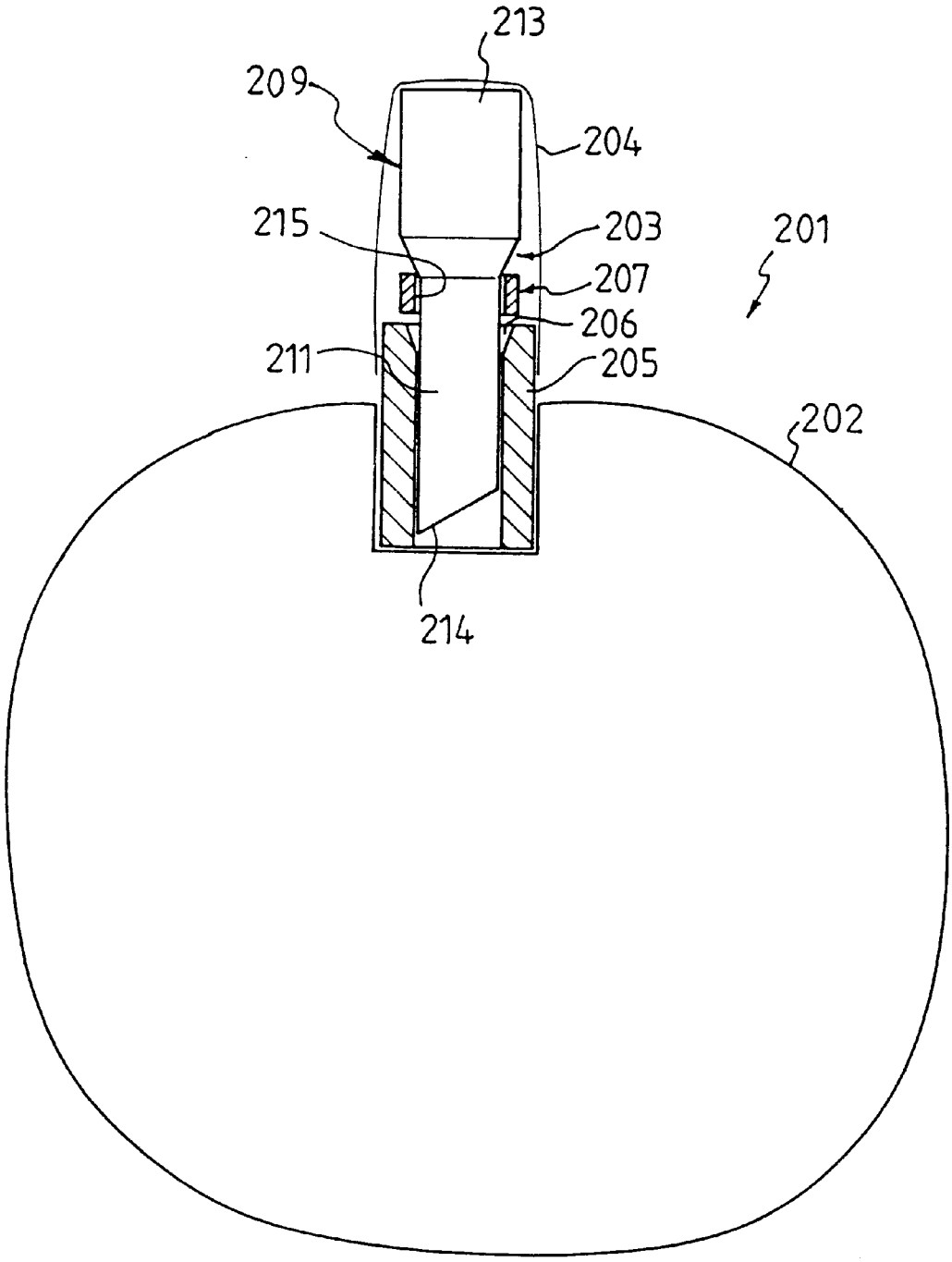
FIG. 12 is a schematic view of the improved drinking container in accordance with the fifth embodiment of the present invention.
Figure 13:
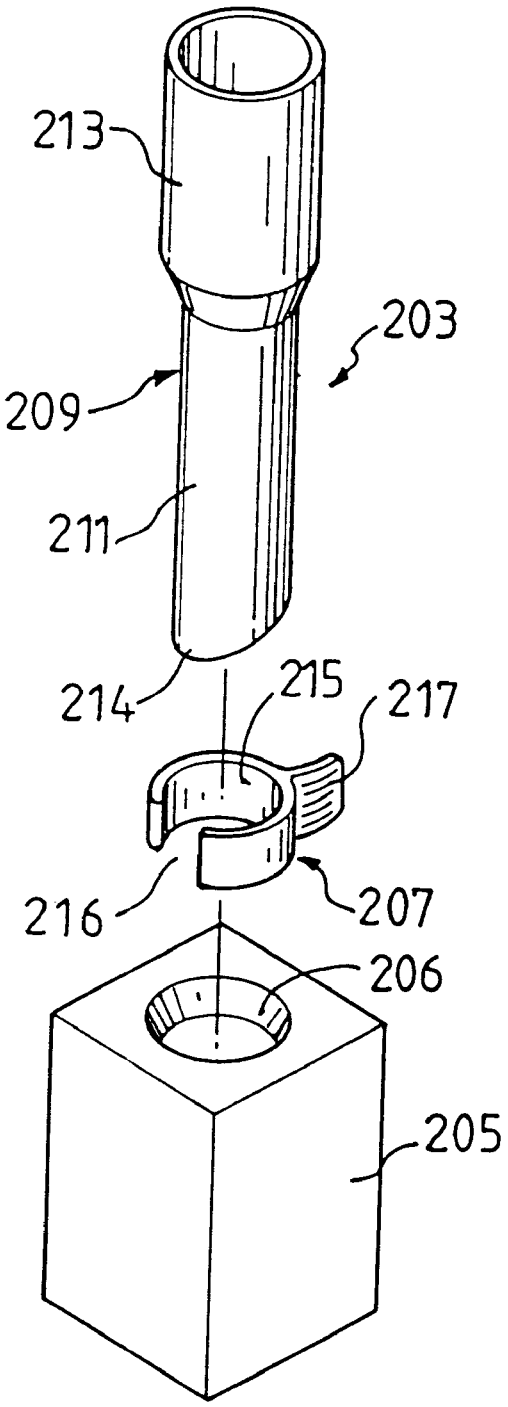
FIG. 13 is an exploded view of the straw assembly of FIG. 12.

FIGS. 12 and 13 show an improved drinking container 201 in accordance with the fifth embodiment of the present invention. As shown, the container 201 comprises a flexible body 202, a straw assembly 203, and a covering 204.

The flexible body 202 is preferably a plastic body, but can also be made of polyolefines, PVC (polyvinyl chloride), aluminum foil, etc.

The straw assembly 203, which is preferably made of plastic, includes a block 205, a stop ring 207 and a straw 209. The block 205 has a through hole which opens at an upper surface of the block 205 to form an opening 206 and open at a lower surface of the block 205. The block 205 is preferably a parallelepiped but can be cylindrical or other shapes, and at least partially, but preferably ½~⅔ portion thereof, is enclosed by the surface of the container body 202. As shown in FIGS. 12 and 13, on the upper surface of the block 205, the edges defining the opening 206 appear outside the body 202 and are tapered.

The straw 209 is divided into a first section 211 and an enlarged second section 213 which is tapered into the first section 211 in accordance with the tapering around the opening 206 of the block 205. The first section 211 is fitted within the block 205 from the opening 206 thereof and has a free end or sharp end 214 on the bottom for piercing the body 202, whereas the enlarged second section 213 cannot pass through the block 205.

The stop ring 207 has a substantially C-shaped cross section and a circumferential wall 215. A notch 216 is formed on the circumferential wall 215 for fitting the stop ring 207 over the first section 211 of the straw 209. Further, a tab 217 extends from the circumferential wall 215 of the stop ring 207. The stop ring 207 is positioned between the opening 206 of the block 205 and the enlarged second portion 213. Preferably, the axial length of the stop ring 207 plus the length of the block 205 is slightly larger than the length of the first section 211 of the straw 209 to prevent the sharp end 214 of the first section 211 from being in contact with the body 202 before use.

Finally, the layer-shaped covering 204, which is preferably made of plastic, paper or aluminum, is used to cover the outer portion of the block 205, the stop ring 207 and the straw 209 to seal the straw assembly 203 therein. Accordingly, the improved drinking container in accordance with the present invention is thus presented.

The operation of the present invention is described in accordance with FIGS. 12, 13. First, a user tears off the covering 204 and pulls the tab 217 of the stop ring 207 to separate the stop ring 207 from the first section 211 of the straw 209. Furthermore, the enlarged second section 213 is pressed toward the block 205 until the body 202 is pierced through by the sharp end 214 of the straw 209. Since the tapered portion of the second section 213 fits tightly with the tapered edges around the opening 206 of the block 205, the liquid will not leak. Accordingly, the user can suck the liquid or jelly food out of the body 202.

Figure 14:
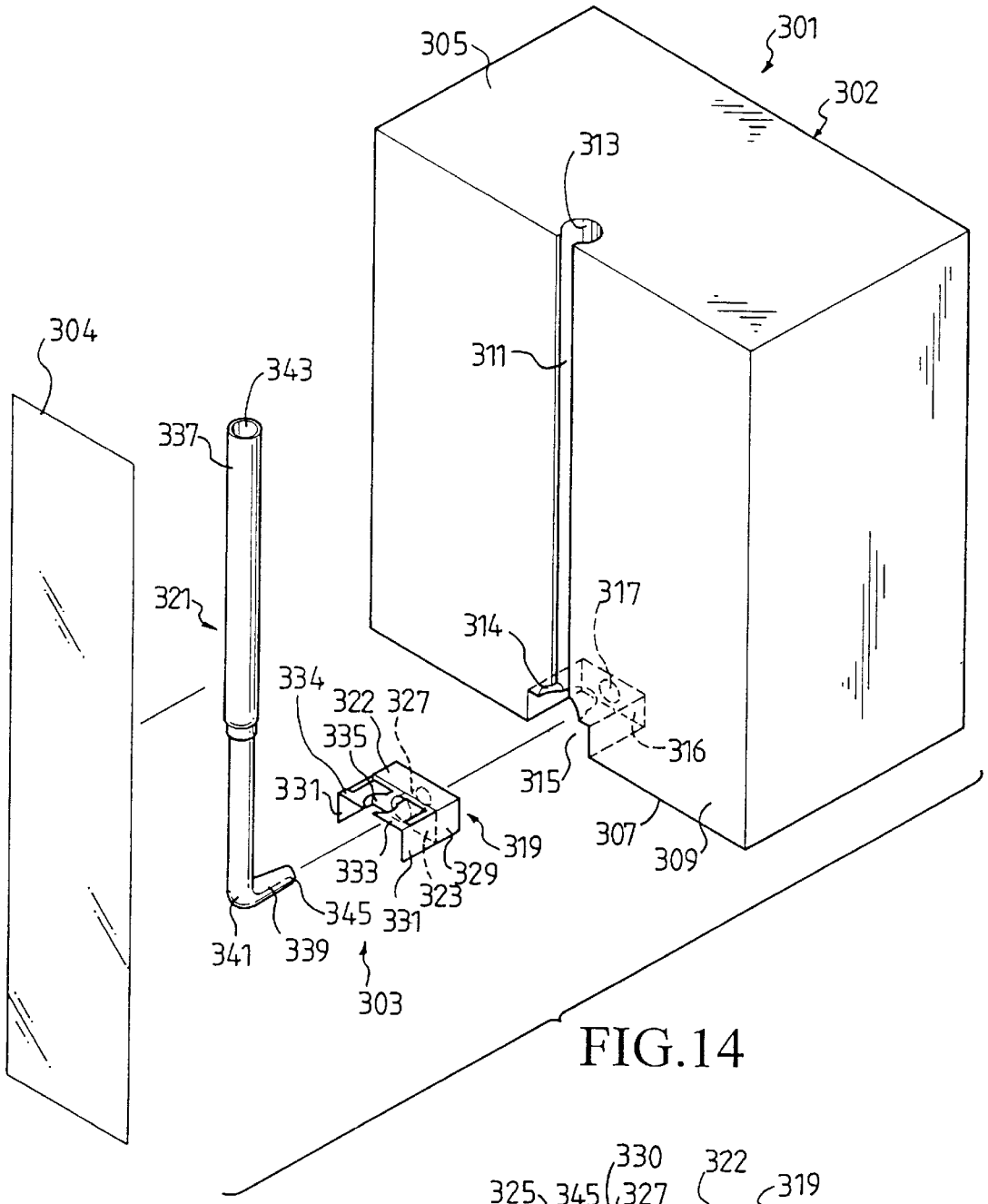
FIG. 14 is a perspective view of the improved drinking container in accordance with the sixth embodiment of the present invention.
Figure 15:
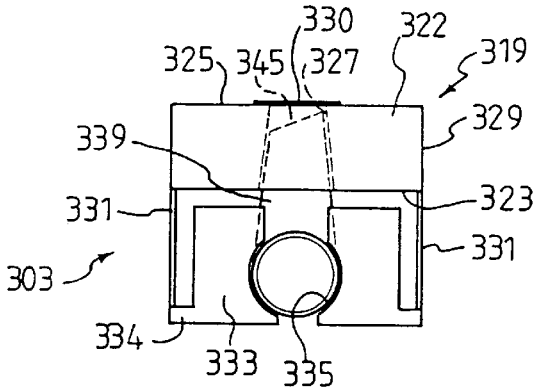
FIG. 15 is a top view of the straw assembly of FIG. 14.

FIGS. 14 and 15 show an improved drinking container 301 in accordance with the sixth embodiment of the present invention. As shown, the container 301 comprises a container body 302, a straw assembly 303, and a covering 304. The container body 302 has a top wall 305, a bottom wall 307 opposite to the top wall 305, and a side wall 309. The side wall 309 is recessed to form a vertical groove 311 from the top wall 305 toward the bottom wall 307. The vertical groove 311 is thus defined by an inner wall 313 with substantially C-shaped cross section which has a longitudinal opening with a width smaller than the diameter of the straw to be inserted therein and will prevent the straw from falling out of the groove 311. Near the bottom wall 307, an end of the vertical groove 311 leads to an enlarged rectangular space 315 which is open to the side wall 309 and the bottom wall 307, and is defined by an inner wall 316 as well as two lateral walls of the container body 302. The enlarged rectangular space 315 has a larger cross section than that of the groove 311. At each of two sides of the groove 311, near the space 315, is recessed into a recess 314. A hole 317 is formed on the inner wall 316.

The container 301 can also be a gable-topped container and the container body 302 may also be made of plastic materials, paper, metals or other suitable materials. In some preferred embodiments, the container body 302 with the vertical groove 311 and rectangular space 315 is made by injection molding.

The straw assembly 303, which is preferably made of plastic, comprises a block 319, and a straw 321. The block 319 is a rectangular parallelepiped having a top wall 322, a front wall 323, a rear wall 325 opposite to the front wall 323, a conical through hole 327 extending and tapering from the front wall 323, through the block 319, to the rear wall 325, as well as two lateral walls 329. A layer of material 330, for example, aluminum foil, is used to seal an opening of the conical through hole 327 on the rear wall 325. A lateral wing 331 further extends from each of the lateral walls 329 and a stop plate 333 is perpendicularly cantilevered to each lateral wing 331 at a joint 334. Therefore, the stop plate 333 is substantially flush with the top wall 322 of the block 319. In addition, as shown in FIGS. 14 and 15, two stop plates 333 co-define a hole 335.

In addition, the block 319 with lateral wings 331 and stop plates 333 as a whole is received within the enlarged rectangular space 315 with the rear wall 325 of the block 319 meeting with the inner wall 316 for the block 319 to be attached thereto. The aforementioned attachment between the block 319 and the inner wall 316 is preferably accomplished by adhesion or ultrasonic bonding and the hole 317 is sealed by the layer of material 330 at the same time. Preferably, a gap exists between the space 315 and the top wall 322 of the block 319. Moreover, after assembling, the hole 335 is aligned with the cross section of the groove 311.

The straw 321 is received within the groove 311 of the container body 302 and is divided into a vertical section 337 and a bent section 339 which are joined together at a joint 341. The vertical section 337 is telescopic and has an end 343 for a mouth. Preferably, near the mouth end 343, a portion of the vertical section 337 is bellowed (not shown). Since the cross section of the groove 311 is C-shaped, the vertical section 337 is blocked by the groove 311 and will not fall from the groove 311. The bent section 339 has a free end or sharp end 345 for piercing the sealed opening.

Near the joint 341, a portion of the vertical section 337 is inserted through the hole 335 which is co-defined by the stop plates 333, such that a portion of the bent section 339 is inserted into the through hole 327 of the block 319 from the front wall 323 of the block 319 with a remaining portion of the bent section 339 left outside the through hole 327.

Moreover, the bent section 339 is tapered in accordance with the tapering of the through hole 327 such that after the sharp end 345 pierces the sealed opening, it can fit frictionally and tightly with the tapered through hole 327 and the liquid cannot leak from the connection between the bent section 339 and the through hole 327.

Preferably, the distance from the center of the hole 335 to the front wall 323 of the block 319 plus the length of the block 319 is slightly greater than the length of the bent section 339 of the straw 321 to prevent the sharp end 345 of the bent section 339 from being in contact with the sealed opening of the container body 302 before use.

Finally, the layer-shaped covering 304, which is made of plastic, paper or aluminum, is used to cover the groove 311 and the enlarged rectangular space 315 to seal the straw assembly 303 therein. Accordingly, the improved drinking container in accordance with the present invention is thus presented.

The operation of the present invention is described in accordance with FIGS. 14 and 15. First, the covering 304 is torn off and the vertical section 337 of the straw 321 is withdrawn to its full extension. Further, the user inserts his fingers into the recesses 314 to press down on both stop plates 333 to break the joint 334, and the joint 341 is pressed toward the inner wall 316 of the container body 302 until the sealed opening of the conical through hole 327 is pierced through by the sharp end 345 of the bent section 339 of the straw 321 and the tapered bent section 339 fits frictionally and tightly with the tapered through hole 327. By adjusting the bellowed portion of the extended vertical section 337 to align the mouth end 343 with the user's mouth, the user can suck the liquid out of the container body 302.

Based on the structures disclosed in the above embodiments, since the straw is received within the vertical groove and sealed by the covering, it is not easily separated from the container body by collision between containers. In addition, dust does not accumulate on the hole and the liquid within the container body is not easily contaminated. Furthermore, there would be no chance for the straw to be lost in the container body as is the case with the conventional packages.

Furthermore, the material for the container body is not limited to plastic or paper, but can be metal, as long as the hole can be formed and well sealed on the surface of the container body.

The structure of the present invention is not limited to the above embodiments. Although the invention has been described with reference to the preferred embodiments, it will be obvious to those skilled in the art that various changes and modifications may be made without departing from the scope of the invention, as recited in the claims.

List of Reference Numerals

| | |
|---|---|
| 1, 1' | Container |
| 2, 2' | Container body |
| 3, 3' | Straw assembly |
| 4 | Layer-shaped covering |
| 5, 5' | Top wall of container body 2, 2' |
| 7, 7' | Bottom wall of container body 2, 2' |
| 9 | Side wall of container body 2 |
| 11, 13, 13', 15 | Inner wall |
| 17, 17' | Vertical groove |
| 19 | Sealed hole |
| 20 | Layer of material |
| 21 | Block |
| 23, 23' | Straw |
| 25, 25' | Stop ring |
| 27, 27' | Rear wall |
| 29 | Front wall |
| 31 | Conical through hole |
| 33, 33' | Vertical section of straw 23, 23' |
| 35 | Bent section of straw 23 |
| 37, 37' | Joint of straw 23, 23' |
| 39, 39' | Mouth end of straw 23, 23' |
| 41, 41' | Free end or sharp end of the bent section 35 |
| 42 | Upper portion of the covering 4 |
| 43 | Circumferential wall of stop ring 25 |
| 44 | Lower portion of the covering 4 |
| 45 | Notch |
| 46 | Intermediate portion of the covering 4 |
| 47 | Tab |
| 49 | Covering |
| 51 | First portion of covering 49 |
| 53 | Second portion of covering 49 |
| 55 | Liquid-resistant layer |
| 57 | Paperboard base material |
| 59 | Polyethylene layer |
| 61 | Liquid-resistant layer |
| 63 | Gas-barrier layer |
| 65 | Adhesive resin layer |
| 67 | Paperboard base material |
| 69 | Polyethylene layer |
| 101 | Container |
| 102, 102' | Flexible body |
| 103, 103' | Straw assembly |
| 104, 104' | Covering |
| 105, 105' | Block |
| 106, 106' | Straw |
| 107, 107' | Insert |
| 108 | Sealed hole |
| 109 | Top wall |
| 111, 111' | Bottom wall |
| 113 | Front wall or side wall |
| 115, 115' | Vertical groove |
| 117 | Inner wall |

-continued

| List of Reference Numerals | |
|---|---|
| 119 | Knob |
| 121, 121' | Conical through hole |
| 122 | Notch |
| 123, 123' | Vertical section of straw 106, 106' |
| 125, 125' | Bent section of straw 106, 106' |
| 127, 127' | Joint of straw 106, 106' |
| 129, 129' | Mouth end of straw 106, 106' |
| 131, 131' | Free end or sharp end of straw 106, 106' |
| 201 | Container |
| 202 | Flexible body |
| 203 | Straw assembly |
| 204 | Covering |
| 205 | Block |
| 206 | Opening of the block 205 |
| 207 | Stop ring |
| 209 | Straw |
| 211 | First section |
| 213 | Enlarged second section |
| 214 | Free end or sharp end of the straw 209 |
| 215 | Circumferential wall |
| 216 | Notch |
| 217 | Tab |
| 301 | Container |
| 302 | Container body |
| 303 | Straw assembly |
| 304 | Covering |
| 305 | Top wall of container body 302 |
| 307 | Bottom wall of container body 302 |
| 309 | Side wall of container body 302 |
| 311 | Vertical groove |
| 313 | Inner wall |
| 314 | Recess |
| 315 | Enlarged rectangular space |
| 316 | Inner wall |
| 317 | Hole |
| 319 | Block |
| 321 | Straw |
| 322 | Top wall of block 319 |
| 323 | Front wall of block 319 |
| 325 | Rear wall of block 319 |
| 327 | Conical through hole |
| 329 | Lateral wall of block 319 |
| 330 | Layer of material |
| 331 | Lateral wing |
| 333 | Stop plate |
| 334 | Joint between lateral wing 331 and stop plate 333 |
| 335 | Hole |
| 337 | Vertical section of straw 321 |
| 339 | Bent section of straw 321 |
| 341 | Joint of straw 321 |
| 343 | Mouth end of straw 321 |
| 345 | Free end or sharp end of straw 321 |

What is claimed is:

1. An improved drinking container, comprising:

a container body having:

a side wall, which is recessed inward to form a vertical groove throughout the side wall, in which the vertical groove is defined by at least one inner wall;

a sealed hole formed on the inner wall; and a straw assembly which is mounted in the vertical groove, the straw assembly including:

a straw having a vertical section, a bent section and a joint at which the vertical section and bent section are joined together, the bent section having a free end for piercing the sealed hole inward;

a block, which has a through hole for the bent section of the straw, being frictionally inserted therethrough, in which the block is secured in the vertical groove with the through hole being aligned with the sealed hole formed on the inner wall of the container body;

whereby the free end of the bent section inserted through the through hole of the block stays out of the sealed hole of the container body before drinking, and by moving the bent section inward, the free end of the bent section pierces the sealed hole to be ready for drinking.

2. The improved drinking container according to claim 1, further comprising a removable stop ring disposed on the bent section between the block and the joint of the straw.

3. The improved drinking container according to claim 2, wherein the stop ring has a notch formed thereon for fitting the stop ring onto the bent section, and the container further comprises a tab connected under the stop ring for a user to easily remove the stop ring from the bent section of the straw.

4. The improved drinking container according to claim 1, wherein the vertical section of the straw is telescopic.

5. The improved drinking container according to claim 1, wherein the vertical section of the straw is bellowed.

6. The improved drinking container according to claim 1, wherein the container body has three inner walls, in which one of the inner walls is substantially parallel with the side wall of the container body and is formed with the sealed hole.

7. The improved drinking container according to claim 1, wherein the container body has an inner wall which is arcuate.

8. The improved drinking container according to claim 4, wherein the container body is a rectangular parallelepiped which includes a top wall and a bottom wall and wherein the container further includes a covering sealing the vertical groove formed on the side wall of the container body so as to fully enclose the straw therein, in which the covering adjacent to the top wall and bottom wall are formed with opening weak lines so that a user may access the vertical section and bent section of the straw.

9. The improved drinking container according to claim 1, wherein the container is a gable-topped container.

10. An improved drinking container, comprising:

a container body having:

a surface; and a sealed hole formed on the surface; and a straw assembly including:

a block having a side wall recessed inward to form a vertical groove throughout the side wall and having a through hole formed at the vertical groove, in which the block is attached to the surface of the container body with the through hole thereof being aligned with the sealed hole formed on the surface of the container body; and a straw having a vertical section, a bent section and a joint at which the vertical section and bent section are joined together, the bent section being frictionally inserted through the through hole of the block and having a free end for piercing the sealed hole inward;

whereby the free end of the bent section inserted through the through hole of the block stays out of the sealed hole of the container body before drinking, and by moving the bent section inward, the free end of the bent section pierces the sealed hole to be ready for drinking.

11. The improved drinking container according to claim 10, wherein the block further comprises a bottom wall to seal an end of the vertical groove.

12. The improved drinking container according to claim 10, wherein the vertical groove is defined by at least one inner wall, and the container further comprises a notch formed near the through hole where the inner wall and the side wall of the vertical groove intersect, as well as a removable insert which is inserted into the through hole and has a curved side for mating with the bent section of the straw to prevent the free end of the bent section from piercing the sealed hole before drinking.

13. The improved drinking container according to claim 10, further comprising at least one knob disposed on the inner wall for preventing the vertical section of the straw from leaving the vertical groove.

14. The improved drinking container according to claim 13, wherein the container further includes a covering sealing the vertical groove which is formed on the side wall of the block so as to fully enclose the straw therein.

15. A straw assembly for use with a drinking container having a surface, including:

a block having a side wall recessed inward to form a vertical groove throughout the side wall and having a through hole formed at the vertical groove, in which the block is attached to the surface of the container; and a straw having a vertical section, a bent section and a joint at which the vertical section and bent section are joined together, the bent section being frictionally inserted through the through hole of the block and having a free end for piercing the surface of the container;

whereby the free end of the bent section inserted through the through hole of the block stays out of the container surface before drinking, and by moving the bent section inward, the free end of the bent section pierces the surface to be ready for drinking.

16. An improved drinking container, comprising:

a container body having a flexible surface; and a straw assembly including:

a block at least partially enclosed by the surface of the container body with an opening thereof appearing outside the container body;

a straw partially received within the block from the opening thereof, in which the straw has a free end for piercing the surface of the container body;

whereby the free end of the straw inserted through the block stays out of the surface of the container body before drinking, and by moving the straw inward, the free end of the straw pierces the surface of the container body to be ready for drinking.

17. The improved drinking container according to claim 16, wherein the straw comprises a first section and an enlarged second section, the first section being fitted within the block, the free end being provided on a bottom end of the first section for piercing the surface of the container body, whereas the enlarged second section cannot pass through the block.

18. The improved drinking container according to claim 17, further comprising a removable stop ring which is disposed on the first section of the straw between the enlarged second section and the opening of the block.

19. The improved drinking container according to claim 18, wherein the stop ring has a notch formed thereon for fitting the stop ring onto the first section, and the container further comprises a tab connected under the stop ring for a user to easily remove the stop ring from the first section of the straw.

20. The improved drinking container according to claim 19, wherein the container further includes a covering sealing the straw assembly appearing outside the container body so as to fully enclose the straw therein.

21. An improved drinking container, comprising:

a container body having:

a side wall, which is recessed inward to form a vertical groove throughout the side wall, in which the vertical groove is defined by at least one inner wall; and a straw assembly which is mounted in the vertical groove, the straw assembly including:

a straw having a vertical section, a bent section and a joint at which the vertical section and bent section are joined together, the bent section having a free end for piercing the sealed hole inward;

a block, which has a through hole for the bent section of the straw being frictionally inserted therethrough, in which the block is secured in the vertical groove with the through hole being sealed at a side facing the inner wall of the container body to form a sealed opening;

at least one stop plate which is attached to the block, the removable stop plate further defining a hole which contains the vertical section of the straw mounted within the vertical groove;

whereby the free end of the bent section inserted through the through hole of the block stays out of the sealed opening before drinking, and by moving the bent section inward, the free end of the bent section pierces the sealed opening to be ready for drinking.

22. The improved drinking container according to claim 21, wherein the container further includes a covering sealing the vertical groove formed on the side wall of the block so as to fully enclose the straw assembly therein.

* * * * *